US005174577A

United States Patent [19]

Warde et al.

[11] Patent Number: 5,174,577

[45] Date of Patent: Dec. 29, 1992

[54] AUDIBLE/TACTILE FEEDBACK SWING TRAINING DEVICE

[75] Inventors: E. D. Warde, Denver; Thomas M. Stephen, Littleton, both of Colo.

[73] Assignee: Natural Swing Products Co., Englewood, Colo.

[21] Appl. No.: 796,577

[22] Filed: Nov. 22, 1991

[51] Int. Cl.[5] ..... A63B 69/36

[52] U.S. Cl. ..... 273/186.2; 446/215; 446/208

[58] Field of Search ..... 446/215, 207, 208, 209, 446/202, 204; 273/186 A, 194 R, 194 A, 194 B, 193 R, 29 A, 26 B, 183 D

[56] References Cited

U.S. PATENT DOCUMENTS

| | | | |
|---|---|---|---|
| 350,521 | 10/1886 | Baldwin | 446/208 |
| 729,891 | 6/1903 | Pierce | 446/215 |
| 1,519,052 | 12/1924 | Reach | 273/194 R |
| 2,823,037 | 2/1958 | La Ferte | 273/186 |
| 3,318,602 | 5/1967 | Kunihisa | 273/194 R X |
| 3,758,117 | 9/1973 | Harrison | 273/194 |
| 3,776,556 | 12/1973 | McLaughlin | 273/186 |
| 3,848,873 | 11/1974 | Linning | 273/186 |
| 4,193,222 | 3/1980 | Deschand | 446/215 |
| 4,576,378 | 3/1986 | Backus | 273/186 |
| 5,030,159 | 7/1991 | Beer | 446/207 X |
| 5,082,283 | 1/1992 | Conley et al. | 273/26 B X |

FOREIGN PATENT DOCUMENTS

| | | | |
|---|---|---|---|
| 18080 | of 1894 | United Kingdom | 446/215 |

*Primary Examiner*—George J. Marlo
*Attorney, Agent, or Firm*—Sheridan, Ross & McIntosh

[57] ABSTRACT

A swing training device which provides both audible and tactile feedback to an individual. In one embodiment, the present invention includes a bow-shaped support structure having two tensioned laterally-displaced vibratable members positioned between the end portions of the structure. When the present invention is fixedly attached to a sports implement, such as by a clip partially encircling the shaft of a golf club, and is swung by the individual, the passage of the vibratable members through the air displaces the vibratable members which initiates their vibration. This vibration provides an audible response and a tactile response to the individual, the magnitude of which is dependent upon the velocity with which the sports implement is swung.

15 Claims, 4 Drawing Sheets

AUDIBLE/TACTILE FEEDBACK SWING TRAINING DEVICE

FIELD OF THE INVENTION

The present invention generally relates to the field of swing training devices and, more particularly, to the field of swing training devices which provide the user with both audible and tactile feedback.

BACKGROUND OF THE INVENTION

Many sporting activities involve swinging some type of an implement such as golf clubs, bats, tennis rackets, or some type of body part such as a leg (e.g., football place kickers). In these types of sporting activities, significant efforts have been expended to develop and refine the associated swing techniques in order to achieve the "best" results on a consistent basis. For instance, in golf enumerable theories have been developed over time relating to the "proper" positioning of the hands and feet at address and throughout the swing, the "proper" posture of the body (e.g., the inclination of the back relative to the legs, the amount of flex in the knees), and the "proper" plane upon which the hands and club head should travel during the swinging motion.

Swing training devices have been developed to expedite the implementation of the swing mechanics associated with the various swing theories in sports. For instance, there are golf training devices which assist the golfer in achieving a repetitive swing by attempting to develop the correct muscle memory associated with a given swing theory. One such device defines the optimum plane for the swing, while another type is designed to maintain the positioning of the arms in a particular orientation throughout the swing. Although these types of golf training devices may be useful, they often fail to take into account the individual characteristics and nuances of each person's natural swing. Other golf training devices simply indicate visually the speed of the club as it passes a given point, the position of the club head at impact, the distance the ball would travel, and/or the ball's direction. Although these devices generate relevant information, they provide only visual feedback which does not assist an individual in developing a "feel" for the swing or how to achieve this "feel." Moreover, in some instances visual feedback devices can actually interfere with "proper" head motion and/or with the individual's concentration on an object, such as a ball.

Due to the large volume of literature which is available on the various swing techniques and training devices such as those discussed above, many individuals have become so enthralled by "swing mechanics" that they have not only lost sight of the primary objective (i.e., to make solid contact with a ball and propel it in a desired direction), but they have also become disconnected with the "feel" of the natural swinging motion. For instance, regardless of which theory is adopted by a particular individual in these types of sports, one important variable always present for achieving the "best" and most consistent results is the acceleration of the given sports implement through the impact zone. One alternative for producing this increase in velocity is for the person to "release" the sports implement at some optimum point during the swing by the action of the wrists and/or hands. The teaching of the release associated with certain sports has been somewhat difficult and it is even more difficult for the individual to develop a "feel" for this releasing action.

U.S. Pat. No. 3,758,117 to Harrison, issued Sep. 11, 1973, and U.S. Pat. No. 4,576,378 to Backus, issued Mar. 18, 1986, both generally disclose golf training devices which may be attached to a lower portion of the shaft of a golf club to attempt to force the user's hands to release the club in the desired manner. For instance, Harrison discloses an airfoil having a longitudinal axis which is substantially parallel to the shaft. The orientation of the airfoil may be altered to "control" the motion of th hands by providing wind resistance during the swinging motion. Backus discloses an inertia attachment device having an arm which is detachably connected to the club shaft on one end while a weight is positioned on its opposite end. The orientation of the weight is adjustable so as to exert a force which pulls the club head, and therefore the user's hands, through on the swing (i.e., it forces the person to release the golf club). Although these types of attachable devices may perform a useful function, the attachment of such devices to a club may adversely affect the weight of the club. Consequently, the "feel" or muscle memory developed when using the club with the device attached thereto may not necessarily equate to the "feel" of the club when not using the device.

A number of other devices currently available do not address physically forcing the development of the user's swing, more particularly, the wrist/hand action, but provide other types of feedback to develop a "feel" for the release. For instance, U.S. Pat. No. 1,519,052 to Reach, issued Dec. 9, 1924, generally discloses an indicator for a golf club which generally includes a tubular member having a reed positioned therein. The detachable device is positioned on the lower portion of the shaft of a golf club on the back portion of the shaft of the club (i.e., on a side opposite the club face). In the event the user takes the club back too fast on the backswing, the reed vibrates and generates a sound to notify the user of this "undesirable" condition, thereby effectively failing to recognize that innumerable tempos have been used in golf over the years to produce consistently desirable results. However, there is no disclosure that the reed provides any type of audible feedback after the backswing (i.e., there is no disclosed audible feedback when swinging the club through the impact zone).

U.S. Pat. No. 2,823,037 to Ferte, issued Feb. 11, 1958, generally discloses a vibratory impulse generator for a golf club. More particularly, Ferte discloses a training or practice golf club (i.e., one which is solely designated for training purposes), which generally has an insert positioned in the face of the training club. A rotatable vertical shaft is included within the insert which has a vane structure attached thereto. Secured to the bottom portion of this shaft is a gear-like structure having a number of teeth. Laterally displaced from the vertical shaft on opposite sides are a pair of wires, pivotally connected near the lower portions thereof, which have one free end which is engageable with the gear teeth and a second free end which is deflectable between two laterally displaced anvils. When the training club is swung, the vane structure rotates the shaft which in turn rotates the gear. Rotation of the gear deflects and moves the ends of the two wires as the teeth intermittently contact the wires, thereby pivoting the wires and causing the movement of the opposite ends to engage the anvils to produce an audible knocking sound. The disclosure also indicates that the user is also provided with a vibratory impulse during the golf swing.

U.S. Pat. No. 3,776,556 to McLaughlin, issued Dec. 4, 1973, discloses another golf club swing training device which utilizes two different pitched whistles to provide user feedback. The detachable device includes a tear-shaped body member having two skewed channels, each of which contain a whistle of a different pitch. The channels and whistles are positioned such that if the user has an inside-out golf swing, one of the whistles will provide sound to feed back information to the user that an "incorrect" swingpath has been used. In the event the user has an outside-in swing, a different pitch whistle sounds to indicate an "incorrect" swingpath. Consequently, if the user swings along the "correct path", no noise feedback is provided.

U.S. Pat. No. 3,848,873 to Linning, issued Nov. 19, 1974, generally discloses a device for indicating acceleration of sports equipment. The device is detachably connectable to a golf club shaft and it may be adjusted to provide noise feedback, but only after a certain predetermined acceleration is achieved during the swing. When this desired acceleration during the swing is achieved, a hammer-like member is released to hit an anvil to provide the user with noise feedback. However, if the desired acceleration is not reached, no noise feedback is ever provided by the device. Moreover, the device does not enhance the development of a smooth swing.

Notwithstanding the foregoing, there remains a need for a swing training device which provides the user with a true "feel" of the swing without forcing the user to swing according to some specified swing theory. Moreover, there is a need for such a swing training device which may be easily attached to a standard implement used in sports without requiring any significant installation tools of any kind. Furthermore, there is a need for such a device which may be detachably connected to a given sports implement such that the sports implement can be retained for normal use in the given sporting activity. In addition, there is a need for such a device which will not appreciably change either the weight or "feel" of the sports implement.

SUMMARY OF THE INVENTION

The present invention is a swing training device which is detachably connectable to a swingable sports implement (e.g., golf clubs, tennis rackets, bats, a kicker's leg) which provides the user with audible and tactile feedback during the swing associated with the given sport. One embodiment generally includes a support structure, which is detachably connectable to the sports implement, and a vibratable member, which extends between displaced portions of the support structure. When the present invention is positioned on the sports implement, preferably such that the vibratable member is substantially perpendicular to the air flow past the implement as it is swung, the present invention provides the desired audible and tactile feedback to the user. More particularly, when the user swings the sports implement, the passing of the vibratable member through the air initiates the vibration thereof such that it provides the user with audible feedback (i.e., a humming sound) as well as tactile feedback through the vibrations which are transferred through the implement to the user's hands. Therefore, as the sports implement accelerates through the impact zone, the user is able to "feel" and hear the amount of speed generated during the swing, any increase or decrease in such speed during subsequent swings, and the smoothness of the swing in its generation of speed.

The support structure functions primarily to provide for the positioning and proper tensioning of the vibratable member in such a manner that the desired user feedback may be generated. In this regard, the support structure may assume a variety of configurations. For instance, in one embodiment the support structure is a bow-shaped member with the vibratable member extending between points which are at or near the ends of the support structure. The bow-shaped member may be preformed into this bow-shaped orientation or it may be a flexible member which will curve into the desired shape when the vibratable member is attached thereto. In another embodiment, the support structure has longitudinally displaced portions with a cavity portion therebetween (e.g., in the general shape of an hourglass) such that the vibratable member may extend across the cavity. In any case, the vibratable member has sufficient room to vibrate when engaging the support structure to provide the desired user feedback.

The vibratable member functions primarily to generate a response to the swinging motion which is provided to a user of the present invention. Although a number of materials and configurations may adequately perform this function when attached to the support structure in an appropriate manner, preferably a natural rubber material with an irregular cross-section (e.g., rectangular) is utilized. The natural rubber material allows the vibratable member to be substantially easily displaced during the swinging motion of a given sport and the irregular cross section further assists in achieving the required displacement by introducing additional air turbulence which enhances the displacement. In order to further increase the sensitivity of the present invention to changes in implement velocity, the vibratable member may be positioned such that at least portions of one surface thereof are skewed relative to the longitudinal axis of the support structure. Moreover, multiple vibratable members may be used.

In one embodiment, the support structure accommodates for the use of two vibratable members which extend between two end portions thereof. The two end portions of the support structure each have laterally displaced notch portions thereon to accommodate the engagement of both vibratable members which are then laterally displaced on the support structure. In order to provide for a simplified engagement between the vibratable members and the support structure and still generate the desired response, such vibratable members in one embodiment are defined by the sides of a single rubber band. Consequently, the rubber band may be positioned on the end portions of the support to engage the notch portions so that the vibratable members, again defined by the two sides of the rubber band, are laterally displaced on the support structure.

The above-described notch portions may also be configured to slightly twist portions of the vibratable member(s) to increase the sensitivity of the present invention to changes in implement velocity and/or decrease the sensitivity of the initial positioning of the present invention on the sports implement. Nonetheless, when the vibratable members are attached to the support structure by engaging the notches and are properly tensioned, the vibratable members have sufficient room to be displaced and initiate the necessary vibrations during the swinging motion. It is noted that there is a complex relation between the cross-section of the vibratable members, their linear mass density and their tension in relation to the frequencies generated.

Once the vibratable members are in place the support structure may be positioned on, for instance, a shaft of a golf club such that the vibratable members are substantially parallel with the shaft. Although the vibratable members are on the side of the shaft opposite the face of the club head, preferably the specific angular orientation of the present invention may be adjusted to improve the response provided by the present invention based upon the individual's swing. When the club is swung, the vibratable members are displaced as they pass through the surrounding air which places the vibratable members into a vibratory state. This vibration provides the user with both audible and tactile feedback, the amount of which is dependent upon the implement speed generated during the swinging motion (e.g., increased humming and/or increased vibrations and/or a change in harmonic balance of generated frequencies indicating an increase in the velocity of the sports implement achieved during the swing). Therefore, the user will develop a "feel" for the swing based upon this variable response.

DETAILED DESCRIPTION

The present invention will be described with reference to the attached drawings which illustrate the pertinent features thereof. The present invention is a swing training device which may be detachably connected to a swingable sports implement such as golf clubs, tennis rackets, bats, or even the leg of a kicker. In order to develop an individual's "feel" for the given swinging motion, the present invention provides both audible and tactile feedback which varies dependent upon, effectively, the linear or vector velocity of the implement generated during the swing.

Figure 1:
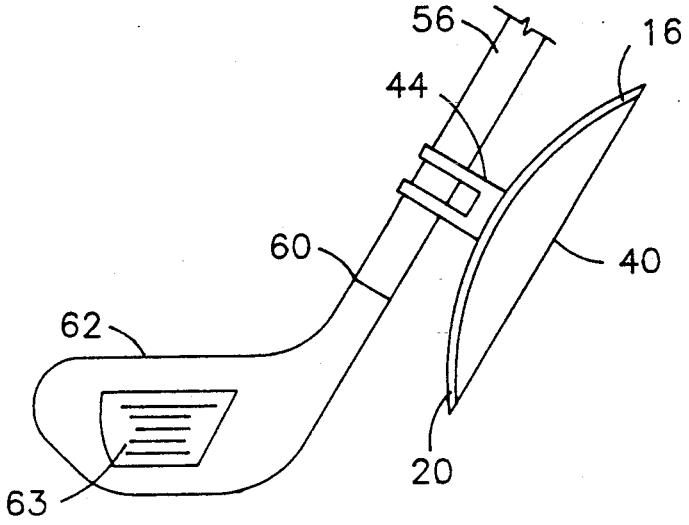
FIG. 1 is a side view of one embodiment of the swing training device of the present invention as attached to a golf club, prior to any adjustment of its angular orientation to achieve suitable performance therefrom.

One embodiment of the present invention is generally illustrated in FIG. 1 and is attached to a golf club 60. The swing training device 16 includes a first support 20, two tensioned vibratable members 40 (only one shown in FIG. 1) which extend between longitudinally displaced portions of the first support 20, and a clip 44 which is appropriately attached to the first support 20 for detachably engaging the golf club 60. In this regard, the clip 44 engages the shaft 56 of the golf club 60 in the region of the head 62 so as to position the vibratable members 40 substantially parallel with the shaft 56. Although various angular orientations may be used, the swing training device 16 is generally positioned on the side of the shaft 56 extending in a direction 90° from the club head 62 (i.e., opposite the club face 63). Consequently, the angular orientation of the device 16 as illustrated in FIG. 1 would be rotated into this general position. When a user then swings the golf club 60, the passage of the vibratable members 40 through the air displaces the vibratable members 40 to initiate their vibration and provides the user with both audible and tactile feedback.

Figure 2:
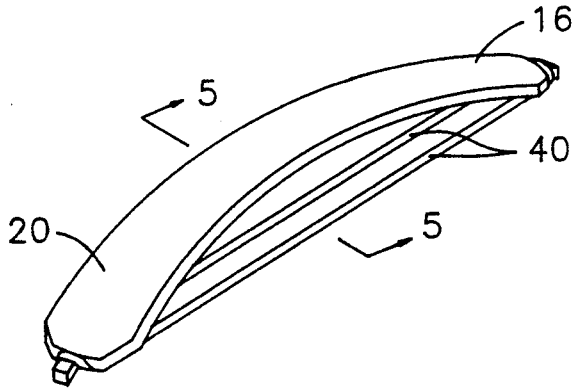
FIG. 2 is a perspective view of one embodiment of the swing training device of the present invention.

The swing training device 16 and the individual components thereof are illustrated in more detail in FIGS. 2–8. The first support 20, illustrated in FIGS. 2–4, primarily functions to support the vibratable members 40 in a manner which allows the vibratable members 40 to be tensioned and displaced during the swinging motion to produce the required vibrations. In this regard, the first support 20 assumes a bow-shaped configuration as illustrated in FIGS. 1–2. This bow-shaped configuration may be achieved by using a first support 20 which is flexible and which is in a substantially planar condition when not under tension. In this case, when the tensioned vibratable members 40 are attached thereto in a manner discussed below, the first support 20 is forced into the desired bow-shaped configuration. Alternatively, the first support 20 may actually be preformed into this bow-shaped configuration. Although relatively the same functionality may be achieved, this alternative may increase manufacturing costs.

Since the first support 20 engages the vibratable members 40, the first support 20 must allow for the vibrations thereof to be generated. In this regard, the first support 20 should initially be of a sufficient length to allow the vibratable members 40 to extend over a distance conducive to producing the desired response without interfering with the displacement of the vibratable members 40. When the first support 20 is positioned flat upon a surface and when the swing training device 16 is used with a golf club 60, the length of the first support 20 may range from about 2 inches to about 12 inches. However, particularly desirable results have been achieved using a length of about 5 inches to about 9 inches. In choosing a length, it should be noted that shorter lengths may adversely affect the magnitude of the response, whereas longer lengths may result in the first support 20 having too great of a damping effect.

The material of the first support 20 also must not significantly dampen the vibrations of the vibratable members 40. For instance, materials having a "soft" durometer rating may introduce an internal damping source which may adversely affect the response of the present invention. Moreover, "soft" materials may also affect the tensioning of the vibratable members 40 (e.g., the vibratable members 40 may bend the first support 20 to an excessive degree resulting in an undesirable reduction in tension of the vibratable members 40).

Various other factors have an input on the materials selection process for the first support 20. For instance, it is desirable for the present invention to be of a relatively light weight s that when attached to the sports implement, the overall weight of the sports implement is not significantly adversely affected. Moreover, the material for the first support 20 should preferably be sunlight resistant (i.e., to avoid becoming brittle over time) and it should be relatively durable. Therefore, based upon the foregoing, the first support 20 may be constructed from certain plastics (e.g., polymer-based materials) and woods, the preferred material being plastic.

The first support 20 engages the vibratable members 40 such that the vibratable members 40 may extend between displaced portions of the first support 20. The preferred vibratable members 40, as will be discussed below, are rubber bands. In this case, two rubber bands (not shown) to define vibratable members 40 may be simply positioned around both ends of the first support 20 to achieve the desired bow-shaped configuration of FIG. 2. Although the portions of the first support 20 which engage the vibratable members 40 need not be of any special configuration (i.e., the ends of the first support 20 may be square such that the first support 20 is completely rectangular (not shown)), performance of the swing training device 16 may be enhanced by slightly altering the positioning of the vibratable members 40 relative to the first support 20 utilizing the engaging portions. Moreover, the engaging portions of the first support 20 may allow for the use of a single rubber band to define the two vibratable members 40.

Figure 3:
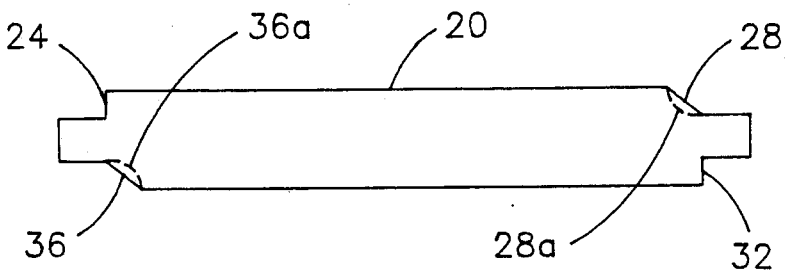
FIG. 3 is a top view of an embodiment of the support structure portion of the present invention.
Figure 5:
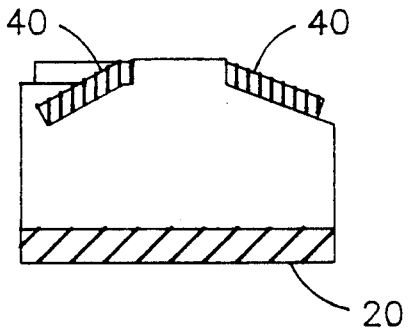
FIG. 5 is an inverted, cross-sectional view of the swing training device of FIG. 2 taken along line 5—5.

Referring to FIG. 3, the first support 20 is illustrated as having first, second, third, and fourth notched portions 24, 28, 32, 36, respectively. First and third notched portions 24, 32 have an engaging surface which is substantially perpendicular to a longitudinal axis of the first support 20. However, the second and fourth notched portions 28, 36 have an engaging surface which is angled relative to such longitudinal axis. When a vibratable member 40 engage the first and second notched portions 24, 28, or the third and fourth notched portions 32, 36, a slight twist is introduced into the vibratable member 40 as illustrated in FIG. 5. As will be discussed below, this twisting is believed to decrease the sensitivity of the swing training device 16 to the positioning of such on the shaft 56 of the golf club 60 (i.e., the swing training device 16, when utilizing this configuration, will provide response over a broader range of angular orientations on the shaft 56) and may improve the overall response offered by the present invention. As an alternative to the angled second and fourth notched portions 28, 36, rounded second and fourth notched portions **28*a*, 36*a* may be used as illustrated by the dashed lines in FIG. 3**.

The first support 20 accommodates for the use of two laterally displaced vibratable members 40. As can be appreciated, a single rubber band may be positioned around the first support 20 to engage the notched portions 24, 28, 32, 36 such that the two vibratable members 40 are defined by the two sides of the rubber band. In this case, it may be desirable to position a small post on each end of the support 20 between the laterally displaced notches to assist in maintaining the position of the single rubber band on the notches 24, 28, 32, 36 (not shown). Alternatively, one rubber band may engage the first and second notched portions 24, 28 to define one vibratable member 40, whereas a second rubber band may engage the third and fourth notched portions 32, 36 to define the second vibratable member 40 (not shown). Regardless of how achieved, the use of this dual vibratable member 40 configuration is believed to enhance the performance of the swing training device 16 by improving the response of the vibratable members 40 to the swinging motion. For instance, it is believed that the leading vibratable member 40 (i.e., which is the leading portion on the downswing) may cut through the air and generate turbulence sufficient to enhance the vibration of the trailing and laterally displaced vibratable member 40. Although a dual vibratable member 40 configuration is illustrated with respect to the swing training device 16, the present invention is not so limited. For instance, a single vibratable member 40 (not shown) may be positioned around or be appropriately attached to the end portions of a first support 20 and still provide a response to the swinging motion.

The primary function of the vibratable members 40 is to provide the desired response by becoming displaced during the swinging motion such that the vibratable members 40 vibrate. In this regard, a number of factors will contribute to the material selection process for this component. For instance, it is desirable to use a material which can be easily displaced and begin vibrating during a swinging motion, even when the velocity of the swing is relatively slow (i.e., a swing used in chipping a golf ball). Therefore, certain elastomeric materials will adequately perform, whereas more rigid materials (e.g., guitar string) may require too high of a velocity for purposes of the present invention.

Figure 7:
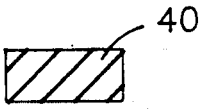
FIG. 7 is a cross-sectional view of the vibratable member of FIG. 6 taken along line 7—7.
Figure 8:
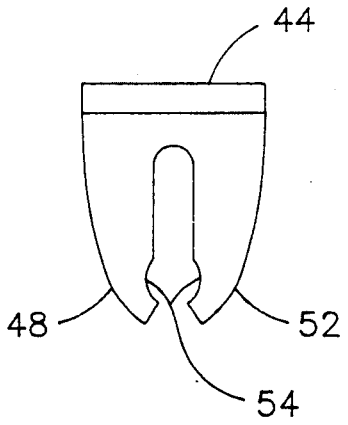
FIG. 8 is an end view of one type of attachment device which connects th swing training device of the present invention to a sports implement.

Another contributing factor to performance of the present invention is the cross-section of the vibratable members 40. Preferably, an irregular cross-section is utilized which promotes the generation of turbulence during the swinging motion which enhances the vibrations. Based upon the foregoing, a preferred vibratable member 40, as discussed above, is a rubber band. A rubber band has a rectangular cross-section as illustrated in FIGS. 5 and 7 and thus promotes the desired turbulence generation. Moreover, the rubber band is easily displaced at the speeds generated during the swinging motions in which the present invention is typically used. Furthermore, rubber bands are cost effective and they may be easily positioned on the first support 20. In addition, the tension within the vibratable members 40 may be adjusted on the first support 20 by altering the portion of the rubber band which engages the first support 20 (i.e., different tensions may be employed in the two longitudinally extending side portions of the rubber band).

Figure 4:
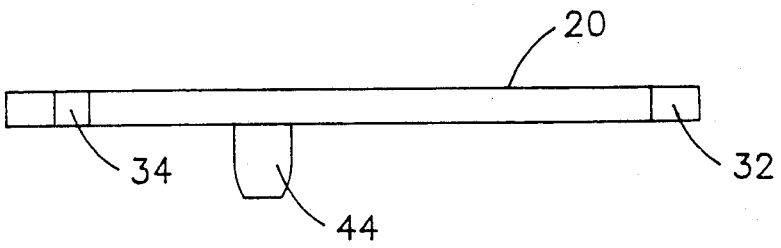
FIG. 4 is a side view of the support structure of FIG. 3.
Figure 6:
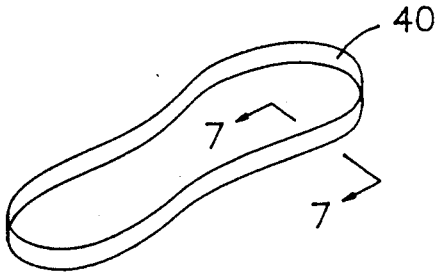
FIG. 6 is a perspective view of an embodiment of a vibratable member.

The swing training device 16 may be detachably connected to the desired sports implement in a number of manners. One type of connector which has been found to be suitable when the swing training device 16 is used with a golf club 60 is the clip 44 illustrated in FIG. 8. Clip 44 generally includes a first deflectable member 48 and a laterally displaced second deflectable member 52, both of which may be deflected outwardly such that the shaft 56 of the golf club 60 may be "snapped" within the cavity 54 of the clip 44. Preferably, in order to reduce vibrational damping effects, the clip 44 should be formed from the same material as the first support 20 and will be attached thereto by, for instance, adhesives, or it alternatively may be integrally formed with the first support 20. The clip 44 may also be positioned off-center on the first support 20 as illustrated in FIG. 4 such that the clip 44 may be attached near the club head 62 without causing the end of the first support 20 to hit the ground during the swing. When the present invention is used with other sports implements, however, it may be necessary to alter the attachment device and/or its positioning on the first support 20.

The above-described swing training device 16 may be attached to a number of sports implements as discussed above. However, solely for purposes of discussion of its use, the swing training device 16 will be described as it could be attached to a gold club 60. The clip 44 snaps around the lower portion of the shaft 56 of the golf club 60 in the region of the club head 62. The swing training device 16 is generally positioned on the side of the shaft 56 90° from the club head 62 (i.e., opposite the club face 63). Therefore, if the club head 62 is labeled as a 12 o'clock position, the vibratable members 40 would generally be at the 3–4 o'clock position. However, depending upon the speed with which the golf club 60 is to be swung, this angular orientation may be adjusted to maximize the response of the present invention. For instance, in lower velocity swings and assuming a right-handed user, it has been determined that placing the vibratable members 40 at the 4 o'clock position produces desirable results. As the speed of the swing increases, the placement of the vibratable members 40 may move more toward the 3 o'clock position to provide the best response. However, the angular orientation actually used may depend upon the individual's swing and therefore the present invention is not limited to the described angular orientations.

When the swing training device 16 is positioned on the golf club 60 as described, the user will be provided with a response which will allow for a development of the "feel" of the swing. In this regard, the swinging of the club 60 will cause the vibratable members 40 to become displaced and start vibrating. This vibration will produce a humming-type noise and thus provides audible feedback to the user. Moreover, this vibration will also be transmitted through the swing training device 16, the shaft 56, the user's hands to provide tactile feedback. As the user experiments with the swing, the present invention will therefore provide an indication of the velocity of the implement achieved during the swing based upon the magnitude of the response. Therefore, the user will be able to develop a swing which may be repeated during play based upon the type of feedback provided by the present invention.

Figure 9:
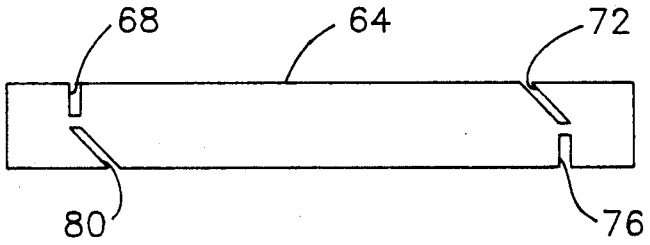
FIG. 9 is a top view of another embodiment of the support structure portion of the present invention.

The present invention generally entails the use of some type of support which allows one or more vibratable members to extend between portions thereof and which may be attached to a sports implement. Therefore, there are, of course, a variety of structural modifications which may be utilized to accomplish this objective, all of which are within the scope of the present invention. For instance, referring to FIG. 9, a second support 64 illustrated therein utilizes first, second, third, and fourth slits 68, 72, 76, and 80 for attaching two vibratable members 40 thereto. In this case, the preferred vibratable members 40 (rubber bands) may be fit within the slits 68, 72, 76, 80 and be relatively secure therein. Furthermore, the second and fourth slits 72, 80 are illustrated as being angulated relative to a longitudinal axis of the second support 64 to introduce the above-discussed desired twist in the vibratable members 40. However, the second and fourth slits 72, 80 may alternatively be configured the same as slits 68, 76 (not shown). Moreover only one set of longitudinally displaced slits need be used if a single vibratable member 40 is to be utilized (not shown).

Figure 10:
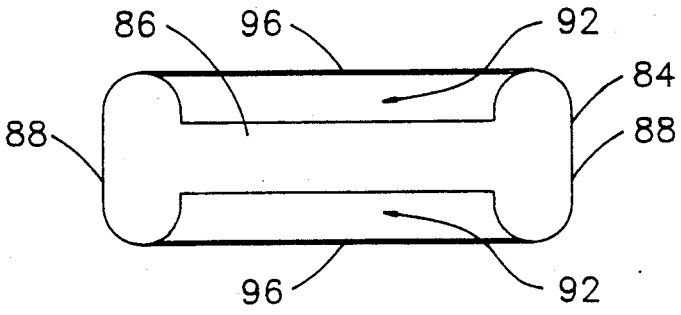
FIG. 10 is a side view of another embodiment of the swing training device of the present invention.
Figure 11:
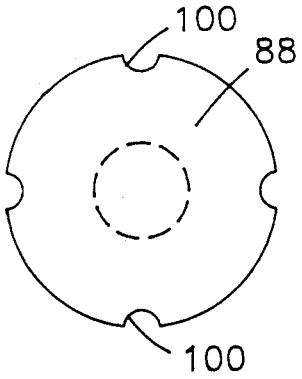
FIG. 11 is an end view of the swing training device of FIG. 10.

Another alternate embodiment of the present invention is illustrated in FIGS. 10–11 in which a swing training device 84 includes a third support 86 having displaced, vertically extending end portions 88 with a shaft 86 positioned therebetween, thereby assuming an hourglass-type configuration. Between these end portions 88 is a cavity 92 which allows the vibratable members 96 positioned between the ends 88 to freely vibrate when the swing training device 84 is attached to a sports implement in an appropriate manner, the cavity 92 being the space between the shaft 86 and the boundary defined by a line tangent to the two ends 88.

For receiving the vibratable members 96, a plurality of notches 100 may be positioned on each of the ends 88 as best illustrated in FIG. 11. Rubber bands may again be used to pass over laterally displaced notches 100 or individual vibratable members 96 may be affixed thereto by, for instance, tying a knot (not shown). Consequently, this configuration allows for a plurality of vibratable members 96 to be utilized (accommodations for four shown) which may be desirable in some applications.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known of practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A swing training apparatus detachably connectable to a swingable sports implement, comprising:

an elongated support which is detachably connectable to the implement and which has first and second spaced apart portions;

tensioned swing responsive vibratable means, engaging and extending between said first and second portions, for providing feedback to a user of the implement when swung; and attaching means for encircling at least a portion of said implement to attach said support exteriorly of said implement at a fixed distance and orientation.

2. An apparatus, as claimed in claim 1, wherein said support is arcuately shaped between said first and second portions.

3. An apparatus, as claimed in claim 1, wherein said support has a cavity between said first and second portions across which said vibratable means extends.

4. An apparatus, as claimed in claim 1, wherein at least a portion of said support comprises a polymer.

5. An apparatus, as claimed in claim 1, wherein at least a portion of said support comprises wood.

6. An apparatus, as claimed in 1, wherein a distance between said first and second portions ranges from approximately 2 inches to approximately 12 inches.

7. An apparatus, as claimed in claim 1, wherein at least one of said first or second portions has a curved surface which engages said vibratable means.

8. An apparatus, as claimed in claim 1, wherein at least one of said first and second portions has a surface which is angled relative to a longitudinal axis of said support for engaging said vibratable means.

9. An apparatus, as claimed in claim 1, wherein said vibratable means comprises an elastomeric material.

10. An apparatus, as claimed in claim 1, wherein said vibratable means comprises a rectangular cross-section.

11. An apparatus, as claimed in claim 1, wherein said vibratable means has a cross-sectional shape that promotes the generation of turbulence when passed through air.

12. An apparatus, as claimed in claim 1, including means for adjusting the tension in said vibratable means.

13. An apparatus, as claimed in claim 1, wherein said vibratable means comprises first and second vibratable members, each which engage laterally displaced portions of both said first and second portions.

14. An apparatus, as claimed in claim 1, wherein at least a portion of said vibratable means is skewed along a length of said vibratable means.

15. An apparatus, as claimed in claim 1, wherein said vibratable means is positionable on the sports implement such that said vibratable means is substantially perpendicular to the air flow past the sports implement when swung.

* * * * *